US005650254A

United States Patent [19]

Eguchi et al.

[11] Patent Number: 5,650,254

[45] Date of Patent: Jul. 22, 1997

[54] IMAGE FORMATION PROCESS

[75] Inventors: Atsuhiko Eguchi; Haruhide Ishida; Yoshifumi Iida; Kaori Ohishi; Takayoshi Aoki; Toshiyuki Yano, all of Minami-ashigara, Japan

[73] Assignee: Fuji Xerox Co., Ltd,, Tokyo, Japan

[21] Appl. No.: 667,649

[22] Filed: Jun. 21, 1996

[30] Foreign Application Priority Data

Jun. 26, 1995 [JP] Japan ..... 7-180589

[51] Int. Cl.[6] ..... G03G 13/22

[52] U.S. Cl. ..... 430/124; 430/110; 430/126; 430/120; 430/111

[58] Field of Search ..... 430/110, 124, 430/126

[56] References Cited

U.S. PATENT DOCUMENTS

| | | | |
|---|---|---|---|
| 4,810,612 | 3/1989 | Ueda et al. | 430/110 |
| 5,298,354 | 3/1994 | Matsunaga et al. | 430/99 |
| 5,362,592 | 11/1994 | Murofushi et al. | 430/110 |
| 5,389,487 | 2/1995 | Kawakami et al. | 430/126 |
| 5,466,555 | 11/1995 | Taguchi et al. | 430/110 |

FOREIGN PATENT DOCUMENTS

| | | |
|---|---|---|
| 52-3304 | 1/1977 | Japan . |
| 57-52574 | 11/1982 | Japan . |
| 58-63947 | 4/1983 | Japan . |
| 59-177570 | 10/1984 | Japan . |
| 60-457 | 1/1985 | Japan . |
| 60-3644 | 1/1985 | Japan . |
| 60-93456 | 5/1985 | Japan . |
| 60-93457 | 5/1985 | Japan . |
| 60-151650 | 8/1985 | Japan . |
| 61-236804 | 10/1986 | Japan . |
| 62-148508 | 7/1987 | Japan . |
| 63-191817 | 8/1988 | Japan . |
| 3-121462 | 5/1991 | Japan . |

*Primary Examiner*—Roland Martin
*Attorney, Agent, or Firm*—Oliff & Berridge

[57] ABSTRACT

A image formation process comprising the steps of forming an electrostatic latent image on an electrostatic latent image carrier, developing the electrostatic latent image with a developer to provide a toner image, transferring the toner image to a transfer material, and heat-fixing the toner image on the transfer material, wherein the developer comprises a toner for developing electrostatic latent images comprising a binder, a colorant, and 1 to 30% by weight of a lubricant which comprises a modified polyethylene wax which is obtained by homopolymerizing ethylene or copolymerizing ethylene and an α-olefin having 3 to 10 carbon atoms in the presence of a metallocene catalyst and modifying the resulting ethylene homo- or copolymer by grafting at least one grafting monomer selected from the group consisting of a styrene monomer and an unsaturated carboxylic acid monomer, and has a hexane extraction of not more than 65% by weight, and wherein the transfer step comprises bringing a bias roll into contact with the back side of a transfer material. The image formation process of the present invention requires less power consumption. The toner for use in the present invention provides a good releasability at low temperatures and shows excellent anti-offset properties and powder fluidity without causing the generation of ozone, image defects and blocking.

5 Claims, 1 Drawing Sheet

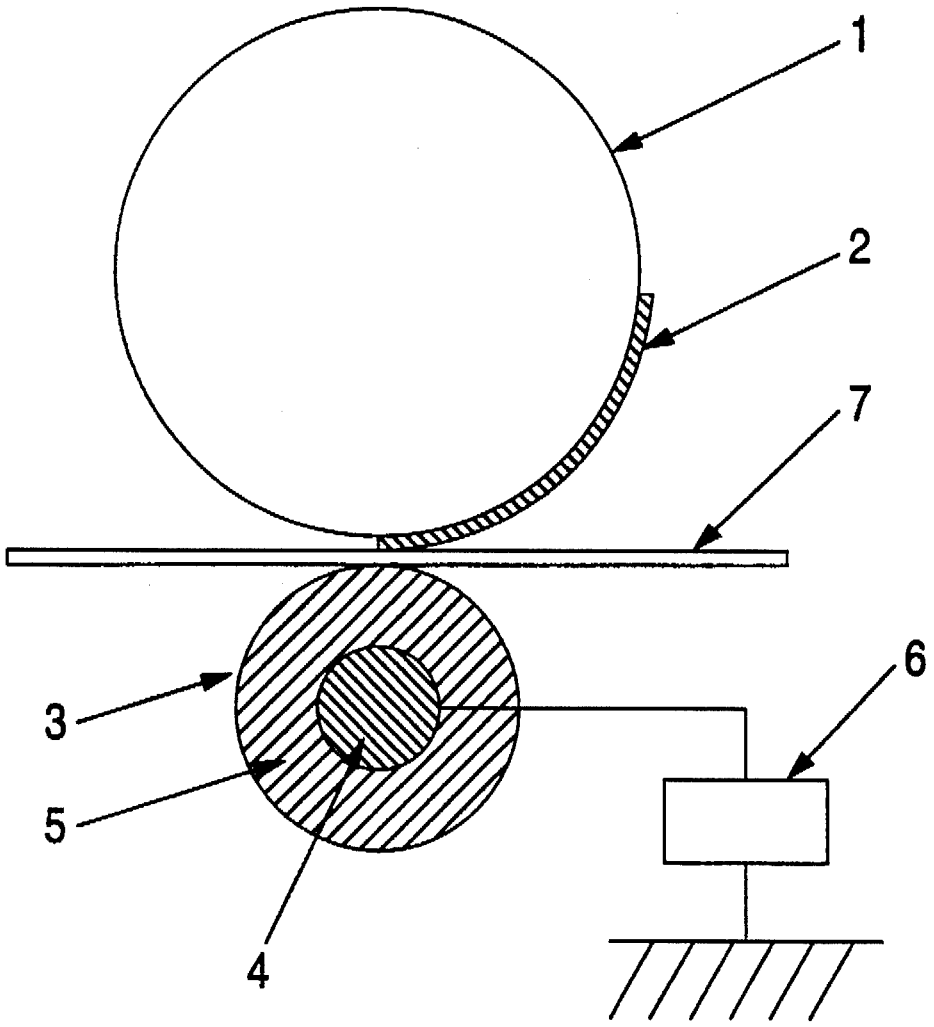
1
2
7
6
3
5
4

IMAGE FORMATION PROCESS

FIELD OF THE INVENTION

The present invention relates to an image formation process for use in the development, transfer and fixing of an electrostatic latent image in electrophotographic process, electrostatic recording process, etc.

BACKGROUND OF THE INVENTION

In an electrophotographic process, a toner is deposited on an electrostatic latent image formed on a photoreceptor made of a photoconducting substance by a magnetic brush development process or the like. The toner image on the photoreceptor is transferred to a transfer material such as paper and a plastic film, and then fixed under heat or pressure or with a solvent to obtain a permanent image. It is thus necessary that the various steps meet various requirements to obtain copied matter.

In particular, in order to obtain a copied image having a high quality, it is necessary that a uniform transfer electric field be formed in the vicinity of the transfer material at the transfer step. Corotron system has been widely used because of its simple mechanism and low cost.

As mentioned above, the corotron system is advantageous in that it requires a simple mechanism and low cost. However, the corotron system is disadvantageous in that it produces ozone upon discharge. Ozone not only is so harmful to human beings that it is placed under strict control but also stains the photoreceptor, causing troubles such as blank areas. The corotron system further has various disadvantages. For example, the corotron system requires a high voltage power supply. This system requires maintenance. For example, deposits such as toner and silicone oil and discharge products must be cleaned off at regular intervals. When the circuit is disconnected, parts must be replaced. Accordingly, a transfer system by a bias roll which causes no production of ozone and requires no maintenance and allows operation at a low voltage has been studied.

In this transfer system, the transfer material is brought into contact with the bias roll to form a transfer electric field. However, when an excess pressure is applied across the transfer material and the bias roll, it is also applied to the photoreceptor and even to the toner image on the photoreceptor. This causes the grains in the toner image to be agglomerated or the toner image to be fixed onto the photoreceptor, inhibiting or disabling the transfer of the toner image to the transfer material. This results in defects in the image transferred to the transfer material, i.e., "blank areas".

In the ordinary development process, a line image has a thicker toner layer towards the center thereof while a solid image has a thicker toner layer towards the edge thereof. Accordingly, blank areas can easily occur in the central part of a line image and in the edge of a solid image or vicinity thereof.

The degree of generation of this phenomenon also depends on the thickness or surface properties of the transfer material. In other words, if the transfer material has a great thickness, the toner image on the photoreceptor undergoes increased pressure and hence tends to suffer from agglomeration and adhesion. If the surface smoothness of the transfer material is high, the adhesivity between the toner grains and the transfer material such as OHP sheet is reduced, causing the generation of blank areas.

Even if the foregoing problems of image quality in the transfer step can be avoided, various problems in the subsequent fixing step must be solved.

In the fixing step, heat-fusing methods have been most frequently employed. These methods can be roughly divided into two types, i.e., contact type system and non-contact type system. In particular, the contact type heat roll fixing system exhibits a good thermal efficiency that allows a high speed fixing. Thus, this system has been widely used in commercial copying machines, printers, etc. in recent years.

However, this heat roll fixing system, too, has some disadvantages. A particularly important disadvantage of this system is that the required amount of energy, i.e., power is rather greater than that of pressure roll fixing system.

Of course, the strength of the fixed image against the transfer material such as paper is far greater in the heat roll fixing system than in the pressure roll fixing system. Further, the heat roll fixing system is also excellent in the prevention of deformation or wrinkle of paper under pressure. It has thus been studied how the power consumption can be reduced in the heat fixing system, that is, how the lowest temperature required for the fixing of the toner can be lowered.

A method useful for the accomplishment of this object includes a method which comprises the use of a toner binder resin having a Tg (glass transition temperature) of scores of degrees lower than that of ordinary binder resin or a toner binder resin having a low molecular weight. However, most of these toners have a fatal defect that it can easily suffer caking or agglomeration during storage or in copying machines.

As a countermeasure for solving the foregoing defect, a method is known which comprises attaching a particulate material such as finely pulverized colloidal silica, alumina or titania to the surface of the toner in an attempt to improve the anti-blocking properties and fluidity of the toner. This countermeasure can provide some improvements in the anti-blocking properties and fluidity without raising the lowest fixing temperature too much and thus seems to be effective. However, it was found that these particulate materials, even if heated to be fused to the surface of the toner, can be easily liberated from the surface of the toner and then exert adverse effects on the photoreceptor, particularly on a photoreceptor coated with an organic polymer or the like. In other words, these particulate materials can be semipermanently fixed to the surface of the photoreceptor after repeated use, causing image defects. Accordingly, this countermeasure cannot be a fundamental solution to the foregoing problems.

Moreover, if a toner comprising a binder resin as described above is used in the heat roll fixing system, it is attached to the heat roll due to its thermal properties, causing an offset phenomenon that stains subsequent copied matter.

Furthermore, in the heat roll fixing system, the fixing roll part is equipped with a peeling claw for preventing the transfer material, paper in general, from being wound on the fixing roll after passing over the fixing roll. However, with the recent rise in the operating speed of copying machines, greater stress is applied to this portion, causing troubles such as release failure and image defects at the front end of the transfer material developed by the peeling claw upon release.

There is a case where a copied image is used as an original to effect further copying. When the copied image is fed into the automatic original feeding apparatus in the copying machine, the original is rubbed by the paper feeding roller in the copying machine to blur or stain the image on the original. In the case of a double-sided original or multi-color original, the surface of the image is rubbed by the paper-feeding roller when it is fed for second copying after the fixing of a first copied image, resulting in the generation of blur or stain on the image. There is a case where a stack of a plurality of originals which has been temporarily stored in a copying machine is withdrawn for second copying one by one by means of a paper feeding roller. In the transfer of these originals, too, the back side of an original is rubbed with the surface of the underlying original to cause rubbing stain or blur on both the two images, resulting in the deterioration of image quality.

In order to eliminate these difficulties, the incorporation of a low molecular weight polypropylene or polyethylene as a lubricant component in a toner has been proposed (JP-B-52-3304 (the term "JP-B" as used herein means an "examined Japanese patent publication"), JP-B-57-52574, JP-A-60-151650 (the term "JP-A" as used herein means an "unexamined Japanese patent publication")).

The toner comprising a lubricant as described above incorporated therein can exert some but insufficient effect of enhancing the anti-offset properties against poor releasability from a heat roll, inhibiting scratches by a peeling claw and enhancing the anti-rubbing strength of fixed image. Further, since this toner has a low compatibility between the polyolefin lubricant and the resin component, a large domain is formed therein, resulting in the marked deterioration of the powder fluidity and agglomeration thereof.

As a method for overcoming these problems, some methods are known such as a method which comprises grafting a polyolefin onto a resin so that it is compatibilized in the resin (JP-A-60-457, JP-A-60-93456, JP-A-60-93457) and a method which comprises the use of a modified polyolefin to disperse the lubricant in the resin (JP-A-58-63947, JP-A-59-177570, JP-A-60-3644, JP-A-62-148508, JP-A-63-191817). These methods can provide an enhanced dispersion of polyolefin, making it possible to somewhat inhibit the deterioration of powder fluidity and agglomeration. However, these methods are disadvantageous in that the effect of enhancing the releasability, which is originally required, is lost.

Further, a method which comprises externally adding a silicone oil- or silicone varnish-treated finely pulverized powder to a toner comprising the foregoing lubricant to inhibit the generation of blank areas has been proposed against the foregoing difficulties encountered when an image made of such a toner is transferred using a bias roll (JP-A-3-121462).

This method can exert its effect in the initial stage. However, this method leaves something to be desired in its effect after a prolonged use. For example, this method is subject to the generation of blank areas, particularly when ordinary paper is used under high-temperature and high-humidity conditions or an OHP sheet is used under low-temperature and low-humidity conditions. Further, this method constitutes control by an external additive and thus provides no fundamental improvements in the toner itself.

SUMMARY OF THE INVENTION

It is therefore an object of the present invention to provide an image formation process which requires less power consumption and thus can provide energy saving that causes no ozone generation and hence gives an excellent environmental safety and can provide a good releasability at low temperatures and show excellent anti-offset properties and powder fluidity without causing image defects, blocking and other troubles.

It is another object of the present invention to provide an image formation process which can provide an image having excellent rub-off resistance without suffering damage by a peeling claw on the fixing roll.

These and other objects of the present invention will become more apparent from the following detailed description and examples.

The present inventors made extensive studies. As a result, it was found that the foregoing problems can be solved by the use of a dry toner in an image formation process comprising a transfer step using a bias roll, said dry toner comprising a binder resin, a colorant and a lubricant, wherein said lubricant is a modified polyethylene wax obtained by grafting with a styrene monomer and/or unsaturated carboxylic monomer produced by a specific process.

The present invention provides a image formation process comprising a latent image formation step of forming an electrostatic latent image on an electrostatic latent image carrier, a development step of developing said electrostatic latent image with a developer to provide a toner image, a transfer step of transferring the toner image to a transfer material, and a fixing step of heat-fixing the toner image on the transfer material, wherein said developer comprises a toner for developing electrostatic latent images comprising a binder, a colorant, and 1 to 30% by weight of a lubricant which comprises a modified polyethylene wax which is obtained by homopolymerizing ethylene or copolymerizing ethylene and an α-olefin having 3 to 10 carbon atoms in the presence of a metallocene catalyst and modifying the resulting ethylene homo- or copolymer by grafting at least one grafting monomer selected from the group consisting of a styrene monomer and an unsaturated carboxylic acid monomer, and said lubricant having a hexane extraction of not more than 65% by weight, and wherein said transfer step comprises bringing a bias roll into contact with the back side of a transfer material.

In the developer of the present invention, the foregoing lubricant preferably comprises a modified polyethylene wax having a melt viscosity of 15 to 250 cP at 160° C. and a penetration of not more than 2 dmm. In the present invention, the foregoing lubricant preferably comprises a modified polyethylene wax having a melt viscosity of 15 to 250 cP and a penetration of not more than 2 dmm obtained by grafting 5 to 30 parts by weight of a styrene monomer and/or unsaturated carboxylic monomer onto 70 to 95 parts by weight of a polyethylene polymer having a density of not less than 0.95 g/cm$^3$, a viscosity-average molecular weight (Mv) of 800 to 3,000 and a molecular weight distribution Mw (weight-average molecular weight)/Mn (number-average molecular weight) of 1.05 to 1.8. The lubricant of the present invention preferably has a hexane extraction of not more than 65% by weight. The binder resin is preferably a styrene-acrylate copolymer.

GPC for measurement of molecular weight distribution (Mw/Mn) of the polyethylene wax as referred to in the present invention was carried out on a chromatograph GPC150C manufactured by Waters, Co. using columns GMH-HT (height: 60 cm) and GMH-HTL (height: 60 cm), both manufactured by Tosoh Corp., connected in series. A 0.1wt % solution of a sample in o-dichlorobenzene was passed through the columns at 140° C. at a flow rate of 1.0 ml/min. The molecular weight of a sample was calculated using a viscosity formula of polyethylene.

The penetration of the polyethylene wax was measured in accordance with JIS K2207. The density was measured in accordance with JIS K6760. The melt viscosity was measured with a Brookfield viscometer at 160° C.

BRIEF DESCRIPTION OF THE DRAWING

FIG. 1 is a diagram of a transfer apparatus illustrating the transfer step in the image formation process according to the present invention.

DETAILED DESCRIPTION OF THE INVENTION

The present invention will be further described hereinafter.

The lubricant for use in the present invention is obtained by grafting a styrene monomer and/or unsaturated carboxylic monomer onto a polyethylene polymer selected from the group consisting of ethylene homopolymer and copolymer of ethylene and an α-olefin having 3 to 10 carbon atoms. The ethylene homopolymer or copolymer should be a product of polymerization in the presence of a metallocene catalyst.

The metallocene catalyst can provide a polymer having a narrower molecular weight distribution than the conventional catalysts. Accordingly, it is not necessary to further narrow the molecular weight distribution by distillation, crystallization and washing with a solvent to accomplish the objects of the present invention. Even if needed, further narrowing of the molecular weight distribution can be efficiently conducted. In view of the advantage of easy control over the molecular weight distribution, the modified polyethylene wax obtained by this polymerization process is advantageous in that it can be easily controlled to have a desired melt viscosity while balancing with other physical properties thereof even within the desired viscosity-average molecular weight range as compared with waxes obtained by conventional processes.

Because of these advantages, the wax polymerized according to this process, though its mechanism being unknown, shows a good dispersibility in a toner and thus shows a high dispersion on the surface of the toner, i.e., interface of the pulverized toner. Furthermore, the wax polymerized by this process has a narrow molecular weight distribution. In particular, the wax is free of extremely low molecular component which is said to have adverse effects on powder properties. Thus, toner particles containing the wax undergoes no agglomeration attributed to wax even under linear pressure upon transfer by the bias roll. Furthermore, the wax can exert an effect of not inhibiting the dispersion of other external additives on the toner surface. Accordingly, the wax obtained according to this process can exert an effect of enhancing the transfer efficiency.

The metallocene catalyst is not particularly limited in kind. Useful metallocene catalysts include catalyst compositions comprised of (A) a compound of a transition metal selected from the elements belonging to groups IVb, Vb and VIb of the Periodic Table and (B) a cocatalyst. Suitable transition metal compounds (A) include those represented by formula (I):

$$ML_x \quad (I)$$

wherein M represents a transition metal atom selected from the group IV elements, e.g., zirconium, titanium or hafnium; x represents the valence of the transition metal M, indicating the number of L; and L represents a ligand or group coordinating to the transition metal M, at least one of which is a ligand having a cyclopentadienyl skeleton, such as a cyclopentadienyl ligand or an indenyl ligand, with the other L's being a group or atom selected from the group consisting of a hydrocarbon group having 1 to 12 carbon atoms, an alkoxy group, an aryloxy group, a trialkylsilyl group, a group $SO_3R^1$, wherein $R^1$ represents a hydrocarbon group having 1 to 8 carbon atoms which may be substituted with a halogen atom, etc., a halogen atom, and a hydrogen atom.

Where the compound of formula (I) contains a plurality of ligands having a cyclopentadienyl skeleton, two of them may be connected to each other via an alkylene group (e.g., ethylene or propylene), an isopropylidene group, a substituted alkylene group (e.g., diphenylmethylene), a silylene group, or a substituted silylene group (e.g., dimethylsilylene or diphenylsilylene).

Specific examples of the transition metal compounds of formula (I) are:

bis(cyclopentadienyl)zirconium dichloride,
bis(methylcyclopentadienyl)zirconium dichloride,
bis(ethylcyclopentadienyl)zirconium dichloride,
bis(n-propylcyclopentadienyl)zirconium dichloride,
bis(n-butylcyclopentadienyl)zirconium dichloride,
bis(n-hexylcyclopentadienyl)zirconium dichloride,
bis(methyl-n-propylcyclopentadienyl)zirconium dichloride,
bis(methyl-n-butylcyclopentadienyl)zirconium dichloride,
bis(dimethyl-n-butylcyclopentadienyl)zirconium dichloride,
bis(n-butylcyclopentadienyl)zirconium dibromide,
bis(n-butylcyclopentadienyl)zirconium methoxychloride,
bis(n-butylcyclopentadienyl)zirconium ethoxychloride,
bis(n-butylcyclopentadienyl)zirconium butoxychloride,
bis(n-butylcyclopentadienyl)zirconium diethoxide,
bis(n-butylcyclopentadienyl)methylzirconium chloride,
bis(n-butylcyclopentadienyl)dimethylzirconium,
bis(n-butylcyclopentadienyl)benzylzirconium chloride,
bis(n-butylcyclopentadienyl)dibenzylzirconium,
bis(n-butylcyclopentadienyl)phenylzirconium chloride,
bis(n-butylcyclopentadienyl)zirconium hydride chloride,
ethylenebis(indenyl)dimethylzirconium,
ethylenebis(indenyl)diethylzirconium,
ethylenebis(indenyl)diphenylzirconium,
ethylenebis(indenyl)methylzirconium monochloride,
ethylenebis(indenyl)ethylzirconium monochloride,
ethylenebis(indenyl)methylzirconium monobromide,
ethylenebis(indenyl)zirconium dichloride,
ethylenebis(indenyl)zirconium dibromide,
ethylenebis[1-(4,5,6,7-tetrahydroindenyl)]dimethylzirconium,
ethylenebis[1-(4,5,6,7-tetrahydroindenyl)]methylzirconium monochloride,
ethylenebis[1-(4,5,6,7-tetrahydroindenyl)]zirconium dichloride,
ethylenebis[1-(4,5,6,7-tetrahydroindenyl)]zirconium dibromide,
ethylenebis[1-(4-methylindenyl)]zirconium dichloride,
ethylenebis[1-(5-methylindenyl)]zirconium dichloride,
ethylenebis[1-(6-methylindenyl)]zirconium dichloride,
ethylenebis[1-(7-methylindenyl)]zirconium dichloride,
ethylenebis[1-(5-methoxyindenyl)]zirconium dichloride,
ethylenebis[1-(2,3-dimethylindenyl)]zirconium dichloride,
ethylenebis[1-(4,7-dimethylindenyl)]zirconium dichloride,
ethylenebis[1-(4,7-dimethoxyindenyl)]zirconium dichloride,
isopropylidene(cyclopentadienyl-fluorenyl)zirconium dichloride,
isopropylidene(cyclopentadienyl-2,7-di-t-butylfluorenyl)zirconium dichloride,
isopropylidene(cyclopentadienyl-methylcyclopentadienyl)zirconium dichloride,
dimethylsilylenebis(cyclopentadienyl)zirconium dichloride,
dimethylsilylenebis(methylcyclopentadienyl)zirconium dichloride,
dimethylsilylenebis(dimethylcyclopentadienyl)zirconium dichloride,
dimethylsilylenebis(trimethylcyclopentadienyl)zirconium dichloride,
dimethylsilylenebis(indenyl)zirconium dichloride, and
diphenylsilylenebis(indenyl)zirconium dichloride.

In the compounds listed above, the disubstituted cyclopentadienyl ring includes a 1,2-substituted ring and a 1,3-substituted ring, and the trisubstituted cyclopentadienyl ring includes a 1,2,3-substituted ring and a 1,2,4-substituted ring. Titanium or hafnium compounds corresponding to the above-listed zirconium compounds are also included in useful transition metal compounds.

As cocatalyst (B), conventional compounds can be used with no particular limitation. An aluminoxane (B-1) and a compound capable of reacting with transition metal compound (A) to form an ionic complex (B-2) can be mentioned as typical examples of cocatalyst (B).

Aluminoxane (B-1) includes organoaluminum compounds represented by formula (II) or (III):

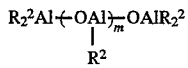

(II)

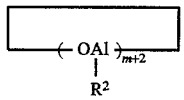

(III)

wherein $R^2$ represents a hydrocarbon group; and m represents an integer of 2 or greater.

The hydrocarbon group as $R^2$ includes methyl, ethyl, propyl, n-butyl, isobutyl, phenyl and phenylmethyl groups, with methyl, ethyl and isobutyl groups being preferred. m is an integer of 2 or greater, preferably 3 to 50, more preferably 3 to 40.

Aluminoxane (B-1) can be prepared by (1) a method comprising reacting a compound containing adsorption water or a salt containing water of crystallization, such as a magnesium hydrate or a copper sulfate hydrate, as suspended in a hydrocarbon medium with an organoaluminum compound, e.g., a trialkylaluminum, to obtain an aluminoxane as dissolved in the hydrocarbon or (2) a method comprising reacting an organoaluminum compound, e.g., a trialkylaluminum, directly with water, ice or steam in a hydrocarbon medium, such as benzene or toluene, to obtain an aluminoxane as dissolved in the hydrocarbon. The organoaluminum compound used includes trimethylaluminum, triethylaluminum, tripropylaluminum, tri-n-butylaluminum, triisobutylaluminum, tri-sec-butylaluminum, tri-t-butylaluminum, and triisopentylaluminum.

Compound (B-2), which is capable of reacting with transition metal compound (A) to form an ionic complex, includes compounds composed of a cation and an anion made up of a plurality of groups bonded to an element. Coordination complex compounds are particularly preferred. Examples of such compounds are trimethylammonium tetraphenylborate, triethylammonium tetraphenylborate, tri(n-butyl)ammonium tetraphenylborate, dimethylanilinium tetra(pentafluorophenyl)borate, triethylammonium tetra(pentafluorophenyl)borate, tri(n-butyl) ammonium tetra(pentafluorophenyl)borate, triethylammonium hexafluoroarsenate, ferrocenium tetraphenylborate, trityl tetraphenylborate, ferrocenium tetra (pentafluorophenyl)borate, methylferrocenium tetra (pentafluorophenyl)borate, decamethylferrocenium tetra (pentafluorophenyl)borate, silver tetra(pentafluorophenyl) borate, trityl tetra(pentafluorophenyl)borate, silver tetrafluoroborate, silver hexafluorophosphate, silver hexafluoroarsenate, silver perchlorate, silver hexafluoroantimonate, silver trifluoroacetate, silver trifluoromethanesulfonate, (N-benzyl-2-cyanopyridinium) tetra(pentafluorophenyl)borate, (N-benzyl-3-cyanopyridinium) tetra(pentafluorophenyl)borate, (N-benzyl-4-cyanopyridinium) tetra(pentafluorophenyl) borate, (N-methyl-2-cyanopyridinium) tetra (pentafluorophenyl)borate, (N-methyl-3-cyanopyridinium) tetra(pentafluorophenyl)borate, (N-methyl-4-cyanopyridinium) tetra(pentafluorophenyl)borate, trimethylammonium tetra(pentafluorophenyl)borate, trimethyl(m-trifluoromethylphenyl)ammonium tetra(pentafluorophenyl) borate, and benzylpyridinium tetra(pentafluorophenyl) borate.

If desired, cocatalyst (B) may be used in combination with an organoaluminum compound (C). The organoaluminum compound includes those represented by formula (IV):

$$R^nAlX_{3-n} \quad \text{(IV)}$$

wherein $R^3$ represents a hydrocarbon group having 1 to 12 carbon atoms; X represents a halogen atom or a hydrogen atom; and n represents an integer of 1 to 3.

The hydrocarbon group as represented by $R^3$ includes an alkyl group and an aryl group, such as methyl, ethyl, n-propyl, isopropyl, isobutyl, pentyl, hexyl, octyl, cyclopentyl, cyclohexyl, phenyl, and tolyl groups. Examples of the organoaluminum compound of formula (IV) include trialkylaluminum compounds, such as trimethylaluminum, triethylaluminum, triisopropylaluminum, triisobutylaluminum, trioctylaluminum, and tri-2-ethylhexylaluminum; alkenylaluminum compounds, such as isoprenylaluminum; dialkylaluminum halides, such as dimethylaluminum chloride, diethylaluminum chloride, diisopropylaluminum chloride, diisobutylaluminum chloride, and dimethylaluminum bromide; alkylaluminum sesquihalides, such as methylaluminum sesquichloride, ethylaluminum sesquichloride, isopropylaluminum sesquichloride, butylaluminum sesquichloride, and ethylaluminum sesquibromide; alkylaluminum dihalides, such as methylaluminum dichloride, ethylaluminum dichloride, isopropylaluminum dichloride, and ethylaluminum dibromide; and alkylaluminum hydrides, such as diethylaluminum hydride and diisobutylaluminum hydride.

The polymerization reaction is carried out in the presence of a metallocene catalyst composition composed of transition metal compound (A), cocatalyst (B) and, if desired, organoaluminum compound (C) in a hydrocarbon solvent. Examples of suitable hydrocarbon solvents are aliphatic hydrocarbons, such as butane, isobutane, pentane, hexane, octane, decane, dodecane, hexadecane, and octadecane; alicyclic hydrocarbons, such as cyclopentane, methylcyclopentane, cyclohexane, and cyclooctane; aromatic hydrocarbons, such as benzene, toluene, and xylene; and petroleum fractions, such as gasoline, kerosine, and gas oil. The olefins used as a monomer can also serve as a hydrocarbon solvent. Of these hydrocarbon solvents preferred are aromatic hydrocarbons.

In carrying out polymerization of ethylene alone or in combination with an α-olefin having 3 to 10 carbon atoms according to solution polymerization, transition metal compound (A) is used in a concentration of $1\times10^{-8}$ to $1\times10^{-2}$ gram-atom/l, preferably $1\times10^{-7}$ to $1\times10^{-3}$ gram-atom/l, in terms of the transition metal atom. Aluminoxane (B-1) is used in a concentration of $1\times10^{-4}$ to $1\times10^{-1}$ gram-atom/l, preferably $1\times10^{-3}$ to $1\times10^{-2}$ gram-atom/l, in terms of aluminum atom. An atomic ratio of aluminum to the transition metal in the polymerization system is usually 4 to $10^7$, preferably 10 to $10^6$.

The molecular weight of the ethylene homo- or copolymer can be controlled through adjustment of the amount of hydrogen and/or the polymerization temperature. The polymerization temperature is usually 20° C. or higher, preferably 50 to 230° C. The amount of hydrogen fed to the polymerization system is usually 0.01 to 4 mol, preferably 0.05 to 2 mol, per mole of the monomer used in the polymerization.

In the present invention, the ethylene homopolymer or copolymer of ethylene and an α-olefin having 3 to 10 carbon atoms obtained by the polymerization in the presence of the foregoing metallocene catalyst preferably has an intrinsic viscosity [η] of not more than 0.4 dl/g, more preferably from 0.005 to 0.35 dl/g, as measured in decalin at 135° C. The ethylene unit content in the ethylene copolymer is usually 80 mol % or more, preferably 85 mol % or more.

The polyethylene wax preferably has a viscosity-average molecular weight (My) of 800 to 3000, a density of not lower than 0.95 g/cm$^3$, and a penetration of not more than 2 dmm, more preferably not more than 1 dmm. A polyethylene wax satisfying these conditions exhibits self-lubrication based on the high density and molecular linearity and therefore reduces abrasive damage on the surface of a fixed image and prevent stains and blurs due to rub-off. That is, such a polyethylene wax forms a self-lubricating film on the surface of a fixed image after passage under a heat roll to fully manifest its lubricating effect.

The ethylene homopolymer or ethylene copolymer (hereinafter simply referred to as "polyethylene wax") of the present invention preferably has a molecular weight distribution of 1.05 to 1.8, more preferably 1.05 to 1.5, still more preferably 1.05 to 1.3 as expressed in terms of weight average molecular weight (Mw) to number average molecular weight (Mn) ratio (Mw/Mn) as measured by gel-permeation chromatography (hereinafter simply referred to as GPC). When the molecular weight distribution (Mw/Mn) falls within the above range, in the above-mentioned viscosity average molecular weight range, it is possible to prevent blocking or deterioration of powder fluidity at room temperature, and also to prevent reduction of resistance against scratches by a peeling claw due to the increase in the melt viscosity.

A molecular weight distribution of a polyethylene wax also has a great influence on the melting behavior of the polyethylene wax itself. A polyethylene wax is required to maintain a completely solid state under usual conditions and, when it passes through a pair of fixing rolls, to be completely melted at the vicinity of a temperature of a fixing roll within a very short time of passage to exert its lubricating effect. If the molecular weight distribution is controlled as described above, the temperature range in which a polyethylene wax completely melts is narrowed. In other words, the proportion of wax components which contribute to release from a fixing roll, i.e., the proportion of wax components which can melt at the temperature of a fixing roll, increases, which leads to improved efficiency in manifestation of the lubricating effect.

If desired, the polyethylene wax as obtained by polymerization may be subjected to degassing in vacuo at the melting point or higher. Low-molecular weight components may be removed from the polyethylene wax by dissolving in a solvent, such as hexane or acetone. Furthermore, high-molecular weight components may be removed by dissolving the whole amount of the polyethylene wax in a solvent, followed by precipitation at a specific temperature.

The foregoing polyethylene polymer is graft-modified with a styrene monomer and/or unsaturated carboxylic monomer. The styrene monomer or unsaturated carboxylic monomer is not specifically limited. Examples of the styrene monomer as a graft-modifying monomer include styrene, α-methylstyrene, 2-methylstyrene, 3-methylstyrene, 4-methylstyrene, 2,5-dimethylstyrene, 3,4-dimethylstyrene, 2,4,6-trimethylstyrene, 2-ethylstyrene, 3-ethylstyrene, 4-butylstyrene, 4-sec-butylstyrene, 4-t-butylstyrene, 4-hexylstyrene, 4-nonylstyrene, 4-octylstyrene, 4-phenylstyrene, 4-decylstyrene, 4-dodecylstyrene, 2-chlorostyrene, 3-chlorostyrene, 4-chlorostyrene, 2,4-dichlorostyrene, 3,4-dichlorostyrene, 2-methoxystyrene, 4-methoxystyrene, and 4-ethoxystyrene.

Examples of the unsaturated carboxylic acid monomer as a graft-modifying monomer include acrylic esters, such as methyl acrylate, ethyl acrylate, butyl acrylate, sec-butyl acrylate, isobutyl acrylate, propyl acrylate, isopropyl acrylate, 2-octyl acrylate, dodecyl acrylate, stearyl acrylate, hexyl acrylate, isohexyl acrylate, phenyl acrylate, 2-chlorophenyl acrylate, diethylaminoethyl acrylate, 3-methoxybutyl acrylate, diethylene glycol ethyl ether acrylate, 2,2,2-trifluoroethyl acrylate; methacrylic esters, such as methyl methacrylate, ethyl methacrylate, butyl methacrylate, sec-butyl methacrylate, isobutyl methacrylate, propyl methacrylate, isopropyl methacrylate, 2-octyl methacrylate, dodecyl methacrylate, stearyl methacrylate, hexyl methacrylate, decyl methacrylate, phenyl methacrylate, 2-chlorophenyl methacrylate, diethylaminoethyl methacrylate, 2-ethylhexyl methacrylate, and 2,2,2-trifluoroethyl methacrylate; maleic esters, such as ethyl maleate, propyl maleate, butyl maleate, diethyl maleate, dipropyl maleate, and dibutyl maleate; fumaric esters, such as ethyl fumarate, butyl fumarate, and dibutyl fumarate; and itaconic esters, such as ethyl itaconate, diethyl itaconate, and butyl itaconate.

A styrene monomer and/or an unsaturated carboxylic acid monomer is/are then grafted to the polyethylene wax for modification. A preferred graft ratio of the grafting monomer is 5 to 30 parts by weight per 100 parts by weight of the resulting graft-modified polymer. Within the preferred graft ratio, the lubricant of the present invention does not form large domains in a toner which would have adverse influences on powder fluidity, anti-blocking properties, and anti-caking properties, and does not show excessive dispersibility in a toner which would reduce the release effect of the lubricant and reduce the image strength against rubbing (rub-off resistance), thereby exhibiting satisfactory performance as a lubricant.

Modification of the polyethylene wax by graft copolymerization can be carried out by various known techniques. For example, a polyethylene wax and a styrene monomer or an unsaturated carboxylic acid monomer are heat-melted and mixed together in the presence of a radical initiator. In this case, the reaction temperature preferably ranges from 125 to 325° C. Useful radical initiators include peroxides, e.g., benzoyl peroxide, lauroyl peroxide, dicumyl peroxide, and di-t-butyl peroxide; and azo compounds, e.g., azobisisobutyronitrile.

The modified polyethylene wax preferably has a melt viscosity of 15 to 250 cP at 160° C. and a penetration of not more than 2 dmm, preferably not more than 1 dmm. Within this range, the cohesive strength of the fixed image and the melt viscosity of the surface of the image immediately after passage under a heat roll are controlled appropriately. As a result, such troubles as scraping of the image with a peeling claw, release failure, and scratches by a peeling claw due to the excessive stress imposed on release are avoided.

The modified polyethylene wax has a hexane extraction of not more than 65% by weight. Within the above range, the wax itself has high anti-blocking properties. As a result, when the modified polyethylene wax having a hexane extraction within the above range is incorporated into toner particles, the toner particles exhibits excellent fluidity without undergoing agglomeration or the like under severe conditions of higher temperature and higher humidity.

The hexane extraction as used herein was determined as follows. Two grams of a wax was placed in a cylinder of filter paper and subjected to extraction with n-hexane for 5 hours at the boiling point using a Soxhlet extractor. The hexane extraction is expressed as a percentage by weight of the amount of the remainder of the wax on the filter.

In the developer of the present invention, the amount of the polyethylene wax thus modified to be incorporated in the toner is preferably from 1 to 30% by weight, particularly from 4 to 10% by weight.

The binder resin for use in the toner of the present invention includes homo- or copolymers comprising a styrene monomer, such as styrene, chlorostyrene or vinylstyrene; a vinyl ester monomer, such as vinyl acetate, vinyl propionate, vinyl benzoate or vinyl butyrate; an α-methylene aliphatic monocarboxylic acid ester monomer, such as methyl acrylate, ethyl acrylate, butyl acrylate, dodecyl acrylate, octyl acrylate, phenyl acrylate, methyl methacrylate, ethyl methacrylate, butyl methacrylate, or dodecyl methacrylate; a vinyl ether monomer, such as vinyl methyl ether, vinyl ethyl ether, or vinyl butyl ether; or vinyl methyl ketone. In addition, polyester resins, polyurethane resins, epoxy resins, silicone resins, and polyamide resins may also be used. While not limiting, preferred among them are polystyrene, a styrene-alkyl acrylate copolymer, a styrene-alkylmethacrylate copolymer, a styrene-acrylonitrile copolymer, a styrene-butadiene copolymer, and a styrene-maleic anhydride copolymer. The binder resin for use in the toner of the present invention is not limited to the above binder resins.

The toner for developing electrostatic latent images of the present invention comprises a colorant incorporated therein as one of major constituents. Typical examples of the colorant include carbon black, and dyes and pigments such as nigrosine dyes, Aniline Blue, Calco Oil Blue, Chrome Yellow, Ultramarine Blue, Du Pont Oil Red, Quinoline Yellow, Methylene Blue chloride, Phthalocyanine Blue, Malachite Green oxalate, lamp black, Rose Bengale, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, and C.I. Pigment Blue 15:3. The colorant for use in the present invention is not limited to the above colorants. The amount of the colorant component to be incorporated in the toner is preferably from 1 to 20% by weight, more preferably from 3 to 12 parts by weight.

If desired, the toner of the present invention may contain known additives, such as a charge control agent. Furthermore, fine particles of other inorganic compounds may be externally added to the toner. For example, colloidal silica fine powder may be added as a fluidity modifier.

In the present invention, the developer may be used as a single-component developer. Alternatively, the developer may be mixed with a carrier to provide a two-component developer. A resin-coated carrier may be used as the carrier for use in the present invention. Specific examples of the resin-coated carrier which is preferably used in the present invention include a particulate material which comprises iron, ferrite, magnetite or the like as a core material and preferably has a grain diameter of from 30 to 200 μm, more preferably from 40 to 100 μm. A resin which has been commonly used may be used as the coating resin for the resin-coated carrier. A fluororesin is mainly used as the coating resin for positively-chargeable toner, i.e., negatively-chargeable carrier. An acrylic resin is mainly used as the coating resin for negatively-chargeable toner, i.e., positively-chargeable carrier.

Examples of the fluororesin include a homopolymer or a copolymer of vinyl fluorine-containing monomer such as vinylidene fluoride, tetrafluoroethylene, hexafluoropropylene and monochlorotrifluoroethylene.

Examples of the acrylic resin include a homopolymer or a copolymer of α-methylenealiphatic monocarboxylic acid such as lauryl acrylate, lauryl methacrylate, methacrylic acid, acrylic acid, butyl methacrylate, 2-ethylhexyl acrylate and ethyl methacrylate. These acrylic monomers may be combined with ethylene, a styrene such as methylstyrene, a nitrile such as acrylonitrile and methacrylonitrile, a vinylpyridine such as 2-vinylpyridine and 4-vinylpyridine, a vinylether, a vinylketone or a silicone such as methyl silicone and methyl phenyl silicone to provide a polymer.

The mixing ratio of the resin-coated carrier to the toner of the present invention is preferably 98:2 to 85:15 by weight, more preferably 97:3 to 90:10 by weight.

The image formation process of the present invention using the foregoing toner will be further described hereinafter. In the image formation process of the present invention, an electrostatic latent image is formed on an electrostatic latent image carrier such as photoreceptor and electrostatic recording material by an electrophotographic process or by means of a needle-like electrode. Useful electrostatic latent image carriers include a known electrostatic latent image carrier such as selenium photoreceptors, organic photoreceptors, amorphous silicon photoreceptors, photoreceptors obtained by overcoating these photoreceptors, and electrostatic recording material having a dielectric substance such as polyethylene terephthalate. The electrostatic latent image thus formed is then developed with the above-described toner. The development of the electrostatic latent image can be accomplished by either the single-component development process or two-component development process. The toner image thus developed is then transferred to a transfer material. In the present invention, the transfer of the toner image can be accomplished by the use of a bias roll. The toner image thus transferred is then heated and fixed by means of a heat roll or the like.

FIG. 1 illustrates the transfer process of the present invention. A toner image 2 has been formed by a development process on an electrostatic latent image carrier 1. A bias roll 3 comprises a core metal 4 coated with a semiconducting elastic layer 5. A bias voltage from a power supply 6 is applied to the core metal 4. The bias voltage application is preferably effected under the conditions of from 0.5 to 30 μA and from 100 to 2,000 V. The semiconducting elastic layer 5 is made of an elastic material having a volume resistivity of from $10^5$ to $10^{11}$ Ω·cm such as polyurethane or styrene-butadiene copolymer comprising an electrically-conductive filler such as carbon dispersed therein. In the transfer system comprising these elements, a transfer material 7 such as paper is inserted into the gap between the electrostatic latent image carrier 1 and the bias roll 3 so that the toner image 2 is transferred to the transfer material 7. The bias roll 3 preferably contacts with a transfer material 7 at a linear pressure of 3 to 12 g/cm, more preferably 5 to 10 g/cm. If the linear pressure exceeds 12 g/cm, a transferred toner image is liable to have blank areas. If the linear pressure is lower than 3 g/cm, the performance of transferring an image is deteriorated. The toner image thus transferred is then subjected to fixing process to provide copied matter. The toner remaining on the surface of the electrostatic latent image carrier 1 is cleaned off. Any known means for cleaning may be used.

The present invention will be further described in the following production examples, examples and comparative examples, but the present invention should not be construed as being limited thereto. The "parts" as used hereinafter is by weight.

Examples of production of polyethylene polymer in the presence of a metallocene catalyst

PREPARATION EXAMPLE A

In a continuous polymerization vessel were fed continuously 200 l/hr of purified hexane, 0.4 mol/hr, in terms of Al atom, of methylalminoxane (produced by Tosoh Corp. and Akuzo Co., Ltd.), 0.2 mol/hr of trimethylaluminum, and 2 mmol/hr, in terms of Zr atom, of bis(n-butylcyclopentadienyl)zirconium dichloride, and ethylene and hydrogen were continuously fed to form a gas phase having a hydrogen to ethylene molar ratio ($H_2/C_2H_4$) of 0.40 and a total pressure of 30 kgf/cm$^2$. Polymerization was carried out at a temperature of 140° C. under normal pressure for a retention time of 0.5 hour to a polymer concentration of 90 g/l. To 1 l of the resulting polymer solution was added 5 l of methanol to precipitate the polymer, and the precipitate was collected by filtration and dried to recover the polymer having the following physical properties.

[η]: 0.08 dl/g

Mw/Mn: 1.30

Viscosity average molecular weight (Mv): 1130

Density: 0.96 g/cm$^3$

Melt viscosity (160° C.): 12.0 cP

PREPARATION EXAMPLE B

A polymer having the following physical properties was prepared in the same manner as in Preparation Example A, except for changing the hydrogen to ethylene molar ratio ($H_2/C_2H_4$) of the gas phase to 0.50.

[η]: 0.06 dl/g

Mw/Mn: 1.20

My: 890

Density: 0.96 g/cm$^3$

Melt viscosity (160° C.): 7.7 cP

PREPARATION EXAMPLE C

In 2000 ml of hexane, 1200 g of a polyethylene wax of Preparation Example A was dissolved at 60° C. The resulting solution was then allowed to stand at 50° C. for 1 hour. After removing thus precipitated impurities by filtration, the filtrate was cooled to 25° C. The resulting precipitate was collected by filtration and then dried. The polymer obtained had the following physical properties.

[η]: 0.06 dl/g

Mw/Mn: 1.12

Mv: 1400

Density: 0.96 g/cm$^3$

Melt viscosity (160° C.): 12.0 cP

PREPARATION EXAMPLE D

A polymer having the following physical properties was prepared in the same manner as in Preparation Example A, except for changing the polymerization temperature to 145° C.

[η]: 0.06 dl/g

Mw/Mn: 1.37

My: 1070

Density: 0.96 g/cm$^3$

Melt viscosity (160° C.): 10.0 cP

Preparation of graft-modified polyethylene waxes

PREPARATION EXAMPLE 1

A thousand grams of the polyethylene wax obtained in Preparation Example A ([η]: 0.08 dl/g; Mw/Mn: 1.30; Mv: 1130; density: 0.96 g/cm$^3$; melt viscosity: 12.0 cP at 160° C.) was melted at 160° C., and 250 g of styrene and 21 g of di-t-butyl peroxide were added thereto dropwise through separate pipes over a period of 4 hours. After completion of the addition, the reaction mixture was allowed to further react at 160° C. for 1 hour. The reaction mixture was degassed in vacuo of 30 mmHg for 1 hour to remove the volatile matter to obtain a modified polyethylene wax having a penetration of 1 dmm or less, a melt viscosity of 28.5 cP at 160° C., and a hexane extraction of 62.5% by weight.

PREPARATION EXAMPLE 2

A modified polyethylene wax having a penetration of 1 dmm or less, a melt viscosity of 17.0 cP at 160° C., and a hexane extraction of 63.0% by weight was prepared in the same manner as in Preparation Example 1, except for using 1000 g of the polyethylene wax of Preparation Example B ([η]: 0.06 dl/g; Mw/Mn: 1.20; Mv: 890; density: 0.96 g/cm$^3$; melt viscosity: 7.7 cP at 160° C.).

PREPARATION EXAMPLE 3

A modified polyethylene wax having a penetration of 1 dmm or less, a melt viscosity of 20.5 cP at 160° C., and a hexane extraction of 58.5% by weight was prepared in the same manner as in Preparation Example 1, except for replacing 250 g of styrene with a mixture of 125 g of styrene and 125 g of dibutyl fumarate.

PREPARATION EXAMPLE 4

A modified polyethylene wax having a penetration of 1 dmm or less, a melt viscosity of 20.0 cP at 160° C., and a hexane extraction of 55.0% by weight was prepared in the same manner as in Preparation Example 1, except for replacing 250 g of styrene with a mixture of 125 g of styrene and 125 g of butyl methacrylate.

PREPARATION EXAMPLE 5

A modified polyethylene wax having a penetration of 1 dmm or less, a melt viscosity of 23.7 cP at 160° C., and a hexane extraction of 61.5% by weight was prepared in the same manner as in Preparation Example 1, except for using 1000 g of the polyethylene wax of Preparation Example C.

PREPARATION EXAMPLE 6

A modified polyethylene wax having a penetration of 1 dmm or less, a melt viscosity of 22.0 cP at 160° C., and a hexane extraction of 70.0% by weight was prepared in the same manner as in Preparation Example 1, except for using 1000 g of a polyethylene wax obtained by polymerization using a Ziegler catalyst (Mv: 900; Mw/Mn: 2.2; density: 0.95 g/cm$^3$; melt viscosity: 10.0 cP at 160° C.).

PREPARATION EXAMPLE 7

A modified polyethylene wax having a penetration of 1 dmm or less, a melt viscosity of 12.0 cP at 160° C., and a hexane extraction of 58.0% by weight was prepared in the same manner as in Preparation Example 1, except for using 1000 g of a polyethylene wax obtained by polymerization using a Ziegler catalyst (Mv: 1070; Mw/Mn: 1.30; density: 0.96 g/cm$^3$; melt viscosity: 12.0 cP at 160° C.), 20 g of styrene and 1.7 g of di-t-butyl peroxide.

PREPARATION EXAMPLE 8

A modified polyethylene wax having a penetration of 2 dmm, a melt viscosity of 130.0 cP at 160° C., and a hexane extraction of 65.0% by weight was prepared in the same manner as in Preparation Example 7, except for replacing 20 g of styrene with a mixture of 125 g of styrene and 540 g of dibutyl fumarate.

PREPARATION EXAMPLE 9

A modified polypropylene wax having a penetration of 1 dmm, a melt viscosity of 250.0 cP at 160° C., and a hexane extraction of 75.0% by weight was prepared in the same manner as in Preparation Example 1, except for using 1000 g of a polypropylene wax (Mv: 3000; Mw/Mn: 2.75; density: 0.89 g/cm$^3$; melt viscosity: 70.0 cP at 160° C.).

PREPARATION EXAMPLE 10

A modified polyethylene wax having a penetration of 1 dmm, a melt viscosity of 22.0 cP at 160° C., and a hexane extraction of 67.0% by weight was prepared in the same manner as in Preparation Example 1, except for using 1000 g of a polyethylene wax of Preparation Example D.

PREPARATION EXAMPLE 11

A modified polyethylene wax having a penetration of 1 dmm, a melt viscosity of 16.0 cP at 160° C., and a hexane extraction of 71.5% by weight was prepared in the same manner as in Preparation Example 10, except for replacing 250 g of styrene with a mixture of 125 g of styrene and 125 g of dibutyl fumarate.

The examples and comparative examples of the present invention will be described hereinafter. The specifications of remodelled version of copying machines are set forth in Table 1.

TABLE 1

| Development process | Type of machine used | Power supply used | Current/voltage for transfer | Linear pressure |
|---|---|---|---|---|
| Single-component | Remodelled version of Vivace 200 | Constant current power supply | −3.5 μA | 6 g/cm |
| Single-component | Remodelled version of Able 3015 | Constant current power supply | +3.5 μA | 6 g/cm |
| Two-component | Remodelled version of Vivace 550 | Constant voltage power supply | −400 V | 8 g/cm |
| Two-component | Remodelled version of FX-5039 | Constant voltage power supply | +400 V | 8 g/cm |

EXAMPLE 1

1) Preparation of Toner:

| | |
|---|---|
| Styrene-butyl acrylate copolymer (80/20) (Mw: 1.5 × 10$^5$) | 100 parts |
| Carbon black (R330, produced by Cabot G.L. Inc.) | 10 parts |

-continued

| | |
|---|---|
| Charge control agent (P-51, produced by Orient Kagaku Kogyo K.K.) | 2 parts |
| Modified polyethylene wax of Preparation Example 1 | 5 parts |

The above components were melt-kneaded in a Banbury mixer, cooled, finely ground in a jet mill, and classified by a classifier to obtain toner particles having an average particle size of 10 μm. To 100 parts of the particulate toner was then added 1 part of particulate titanium oxide having an average primary grain diameter of 0.015 μm. The mixture was then subjected to dispersion by means of a Henschel mixer to prepare a toner.

2) Preparation of carrier

A ferrite core having a grain diameter of 85 μm was coated with a silicone resin to obtain a carrier.

3) Preparation of developer 3 parts of the foregoing toner and 97 parts of the foregoing carrier were mixed to prepare a two-component developer composition.

EXAMPLE 2

A developer composition was prepared in the same manner as in Example 1 except for using the modified polyethylene wax set forth in Preparation Example 2 as a lubricant.

EXAMPLE 3

A developer composition was prepared in the same manner as in Example 1 except for using the modified polyethylene wax set forth in Preparation Example 3 as a lubricant.

EXAMPLE 4

A developer was prepared in the same manner as in Example 1 except for using the modified polyethylene wax set forth in Preparation Example 5 as a lubricant.

COMPARATIVE EXAMPLE 1

A developer was prepared in the same manner as in Example 1 except for using, as a lubricant, a polyethylene wax obtained by polymerization using a Ziegler catalyst (Mv: 2000; Mw/Mn: 2.60; density: 0.97 g/cm$^3$, melt viscosity: 85.0 cP at 160° C.; hexane extraction: 45.0% by weight).

COMPARATIVE EXAMPLE 2

A developer was prepared in the same manner as in Example 1 except for using the modified polypropylene wax set forth in Preparation Example 6 as a lubricant.

COMPARATIVE EXAMPLE 3

A developer was prepared in the same manner as in Example 1 except for using the modified polyethylene wax set forth in Preparation Example 8 as a lubricant.

COMPARATIVE EXAMPLE 4

A developer was prepared in the same manner as in Example 1 except for using the modified polyethylene wax set forth in Preparation Example 10 as a lubricant.

EXAMPLE 5

1) Preparation of Toner:

| | |
|---|---|
| Styrene-butyl acrylate copolymer (80/20) (Mw: $1.5 \times 10^5$) | 100 parts |
| Carbon black (Black Pearls 1300, produced by Cabot G.L. Inc.) | 10 parts |
| Charge control agent (TRH, produced by Hodogaya Chemical Co., Ltd.) | 2 parts |
| Modified polyethylene wax of Preparation Example 4 | 5 parts |

The above components were melt-kneaded in a Banbury mixer, cooled, finely ground in a jet mill, and classified by a classifier to obtain toner particles having an average particle size of 10 μm. To 100 parts of the particulate toner was then added 0.5 part of particulate hydrophobic silica having an average primary grain diameter of 0.012 μm. The mixture was then subjected to dispersion by means of a Henschel mixer to prepare a toner.

2) Preparation of carrier

A ferrite core having a grain diameter of 85 μm was coated with a poly(methyl methacrylate) resin to obtain a carrier.

3) Preparation of developer

Three parts of the foregoing toner and 97 parts of the foregoing carrier were mixed to prepare a two-component developer composition.

COMPARATIVE EXAMPLE 5

A developer was prepared in the same manner as in Example 4 except for using the modified polyethylene wax set forth in Preparation Example 7 as a lubricant.

COMPARATIVE EXAMPLE 6

A developer was prepared in the same manner as in Example 4 except for using the modified polyethylene wax set forth in Preparation Example 9 as a lubricant.

COMPARATIVE EXAMPLE 7

A developer was prepared in the same manner as in Example 4 except for using the modified polyethylene wax set forth in Preparation Example 11 as a lubricant.

The developer compositions obtained in Examples 1 to 5 and Comparative Examples 1 to 7 were then subjected to various tests. The testing methods and criteria of evaluation used are as follows.

(1) Generation of blank areas

For the evaluation of generation of blank areas, the developers obtained in Examples 1 to 4 and Comparative Examples 1 to 4 were supplied into a remodelled version of Vivace 550 (manufactured by Fuji Xerox Co., Ltd.) The developers obtained in Example 5 and Comparative Examples 5 to 7 were supplied into a remodelled version of FX-5039 (manufactured by Fuji Xerox Co., Ltd.). These developers were then subjected to copying of 50,000 sheets of an image having 1,500 characters such as Chinese characters and alphabetic letters under high-temperature and high-humidity conditions (30° C., 90% RH) and low-temperature and low-humidity conditions (10° C., 20% RH). These copies were then observed for generation of blank areas.

When the generation of blank areas was not more than 15 to 20%, it was considered to be a practically acceptable level.

2) Offset Temperature:

A copying test was carried out using a fixing unit Vivace 550 (remodelled) manufactured by Fuji Xerox Co., Ltd. The heat roll temperature was stepwise increased from 180° C. up to 250° C. by 5° C., and the temperature at which offset was observed visually was read. In Table 3, "no occurrence" means that offset occurrence was not observed at 250° C.

3) Temperature Causing no Scratches by Peeling claw (Non-scratch Temperature):

A copying test was carried out using a fixing unit Vivace 550 (remodelled) manufactured by Fuji Xerox Co., Ltd. at a varied heat roll temperature, and the scratches appearing on the front edge portion of a solid toner image due to the peeling claw were observed. The temperature at which the observed scratches were on a practically acceptable level was read. In Table 3, "no occurrence" means that no scratch was observed at the lowest testing temperature of 140° C.

4) Rub-off Resistance:

A test was carried out using an automatic original feed system of Vivace 550 (remodelled) manufactured by Fuji Xerox Co., Ltd. Five originals were set in the system and fed. The stains on the back side of the second to fifth originals was observed visually and graded as follows.

G0 . . . No back side stains was observed.

G1 . . . Back side stains hardly perceptible were visually observed.

G2 . . . Back side stains perceptible were visually observed.

G3 . . . Back side stains clearly noticeable were visually observed.

Grades G0 and G1 are levels acceptable for practical use.

5) Storage Stability:

The developer was allowed to stand at 50° C. and 50% RH for 17 hours and then sifted through a vibratory screen having an opening size of 63 μm for 5 minutes to examine anti-blocking properties.

G1 . . . The63 μm screen pass ratio was 70% or more.

G2 . . . The 63 μm screen pass ratio was 40% or more and less than 70%.

G3 . . . the 63 μm screen pass ratio was less than 40%.

6) The amount of the toner transfer

The toner particles before adding a hydrophobic colloidal silica externally thereto in each Example and Comparative Example had been maintained at a condition of 40° C./50% RH for 8 hours. Then, the amount of the toner transfer per minute by a toner box of Vivace 800 (remodelled) manufactured by Fuji Xerox Co., Ltd. was measured.

The results of the evaluation of the developers obtained in Examples 1 to 5 and Comparative Examples 1 to 7 are set forth in Tables 2 and 3.

TABLE 2

| Example No. | Starting Wax Kind | Mv | Mw/Mn | Density (g/cm³) | Melt Viscosity* (cP) | Grafting Material Kind | Graft Ratio (part by weight) | Kind | Graft Ratio (part by weight) | Modified Wax Penetration (dmm) | Melt Viscosity* (cP) | Hexane Extraction (%) |
|---|---|---|---|---|---|---|---|---|---|---|---|---|
| Example 1 | polyethylene | 1130 | 1.30 | 0.96 | 12.0 | styrene | 25 | — | — | ≦1 | 28.5 | 62.5 |
| Example 2 | polyethylene | 890 | 1.20 | 0.96 | 7.7 | styrene | 25 | — | — | ≦1 | 17.0 | 63.0 |
| Example 3 | polyethylene | 1130 | 1.30 | 0.96 | 12.0 | styrene | 12.5 | dibutyl fumarate | 12.5 | ≦1 | 20.5 | 58.5 |
| Example 4 | polyethylene | 1400 | 1.12 | 0.96 | 12.0 | styrene | 25 | — | — | ≦1 | 23.7 | 61.5 |
| Example 5 | polyethylene | 1130 | 1.30 | 0.96 | 12.0 | styrene | 12.5 | butyl methacrylate | 12.5 | ≦1 | 20.0 | 55.0 |
| Comparative Example 1 | polyethylene | 2000 | 2.60 | 0.97 | 85.0 | — | — | — | — | — | — | 45.0 |
| Comparative Example 2 | polyethylene | 900 | 2.20 | 0.95 | 10.0 | styrene | 25 | — | — | ≦1 | 22.0 | 70.0 |
| Comparative Example 3 | polyethylene | 1070 | 1.30 | 0.96 | 12.0 | styrene | 12.5 | dibutyl fumarate | 54 | 2 | 130 | 65.0 |
| Comparative Example 4 | polyethylene | 1070 | 1.37 | 0.96 | 10.0 | styrene | 25 | — | — | 1 | 22.0 | 67.0 |
| Comparative Example 5 | polyethylene | 1070 | 1.30 | 0.96 | 12.0 | styrene | 2 | — | — | ≦1 | 12.0 | 58.0 |
| Comparative Example 6 | polypropylene | 3000 | 2.80 | 0.89 | 70.0 | styrene | 25 | — | — | 1 | 250 | 75.0 |
| Comparative Example 7 | polyethylene | 1070 | 1.37 | 0.96 | 10.0 | styrene | 12.5 | dibutyl fumarate | 12.5 | 1 | 16.0 | 71.5 |

Note:
*Measured at 160° C.

TABLE 3

| Example No. | Generation of Blank Areas 30° C., 90% RH (%) | 10° C., 20% RH (%) | Offset Temperature (°C.) | Non-scratch Temperature (°C.) | Rub-off Resistance | Storage Stability | Toner Transfer (g/min) |
|---|---|---|---|---|---|---|---|
| Example 1 | 13 | 15 | no occurrence | no occurrence | G0 | G1 | 1.6 |
| Example 2 | 17 | 16 | no occurrence | no occurrence | G1 | G1 | 1.7 |
| Example 3 | 15 | 16 | no occurrence | no occurrence | G0 | G1 | 1.5 |
| Example 4 | 12 | 13 | no occurrence | no occurrence | G0 | G1 | 1.9 |
| Example 5 | 15 | 19 | no occurrence | no occurrence | G0 | G1 | 1.5 |
| Comparative Example 1 | 76 | 87 | 211 | 153 | G0 | G3 | 0.2 |
| Comparative Example 2 | 42 | 48 | 220 | 164 | G1 | G2 | 0.4 |
| Comparative Example 3 | 54 | 63 | 239 | no occurrence | G2 | G3 | 0.3 |
| Comparative Example 4 | 42 | 50 | 230 | 148 | G1 | G2 | 0.3 |
| Comparative Example 5 | 30 | 34 | 223 | 174 | G2 | G1 | 1.2 |
| Comparative Example 6 | 46 | 51 | 231 | 163 | G3 | G2 | 1.2 |
| Comparative Example 7 | 48 | 61 | 238 | 136 | G2 | G2 | 0.7 |

EXAMPLE 6

Preparation of Toner:

| | |
|---|---|
| Styrene-butyl acrylate copolymer (80/20) (Mw: $1.5 \times 10^5$) | 100 parts |
| Magnetic material powder (EPT-1000, produced by Toda Kogyo Corp.) | 100 parts |
| Charge control agent (TRH, produced by Hodogaya Chemical Co., Ltd.) | 2 parts |
| Modified polyethylene wax of Preparation Example 1 | 5 parts |

The above components were powder-mixed with a Henschel mixer. The resulting mixture was headed and melt-kneaded with an extruder, cooled, finely ground in a jet mill, and classified by a classifier to obtain toner particles having an average particle size of 10 μm. To 100 parts of the particulate toner was then added 0.3 part of particulate hydrophobic silica having an average primary grain diameter of 0.012 μm. The mixture was then subjected to dispersion by means of a Henschel mixer to prepare a single-component developer composition.

COMPARATIVE EXAMPLE 8

A single-component developer was prepared in the same manner as in Example 5 except for using the modified polyethylene wax set forth in Preparation Example 6 as a lubricant.

COMPARATIVE EXAMPLE 9

A single-component developer was prepared in the same manner as in Example 5 except for using the modified polyethylene wax set forth in Preparation Example 7 as a lubricant.

COMPARATIVE EXAMPLE 10

A single-component developer was prepared in the same manner as in Example 5 except for using the modified polyethylene wax set forth in Preparation Example 10 as a lubricant.

EXAMPLE 7

Preparation of Toner:

| | |
|---|---|
| Styrene-butyl acrylate copolymer (80/20) (Mw: $1.5 \times 10^5$) | 100 parts |
| Magnetic material powder (EPT-1000, produced by Toda Kogyo Corp.) | 100 parts |
| Charge control agent (P-51, produced by Orient Kagaku Kogyo K.K.) | 2 parts |
| Modified polyethylene wax of Preparation Example 1 | 5 parts |

The above components were powder-mixed with a Henschel mixer. The resulting mixture was headed and melt-kneaded with an extruder, cooled, finely ground in a jet mill, and classified by a classifier to obtain toner particles having an average particle size of 10 μm. To 100 parts of the particulate toner was then added 0.5 part of particulate hydrophobic silica having an average primary grain diameter of 0.012 μm. The mixture was then subjected to dispersion by means of a Henschel mixer to prepare a single-component developer composition.

EXAMPLE 8

A single-component developer was prepared in the same manner as in Example 6 except for using the modified polypropylene wax set forth in Preparation Example 2 as a lubricant.

EXAMPLE 9

A single-component developer was prepared in the same manner as in Example 6 except for using the modified polyethylene wax set forth in Preparation Example 4 as a lubricant.

EXAMPLE 10

A single-component developer was prepared in the same manner as in Example 6 except for using the modified polyethylene wax set forth in Preparation Example 5 as a lubricant.

COMPARATIVE EXAMPLE 11

A single-component developer was prepared in the same manner as in Example 6 except for using, as a lubricant, a polyethylene wax obtained by polymerization using a Ziegler catalyst (Mv: 2000; Mw/Mn: 2.60; density: 0.97 g/cm$^3$; melt viscosity: 85.0 cP at 160° C.; hexane extraction: 45% by weight).

COMPARATIVE EXAMPLE 12

A single-component developer was prepared in the same manner as in Example 6 except for using the modified polyethylene wax set forth in Preparation Example 8 as a lubricant.

COMPARATIVE EXAMPLE 13

A single-component developer was prepared in the same manner as in Example 6 except for using the modified polypropylene wax set forth in Preparation Example 9 as a lubricant.

COMPARATIVE EXAMPLE 14

A single-component developer was prepared in the same manner as in Example 6 except for using the modified polyethylene wax set forth in Preparation Example 11 as a lubricant.

The developer compositions obtained in Examples 6 to 10 and Comparative Examples 8 to 14 were then subjected to various tests. The testing methods and criteria of evaluation used are as follows.

(1) Generation of blank areas

For the evaluation of generation of blank areas, the developers obtained in Examples 6 and Comparative Examples 8 to 10 were supplied into a remodelled version of Vivace 200 (manufactured by Fuji Xerox Co., Ltd.) The developers obtained in Example 7 to 10 and Comparative Examples 11 to 14 were supplied into a remodelled version of Able 3015 (manufactured by Fuji Xerox Co., Ltd.). These developers were then subjected to copying of 50,000 sheets of an image having 1,500 characters such as Chinese characters and alphabetic letters under high-temperature and high-humidity conditions (30° C., 90% RH) and low-temperature and low-humidity conditions (10° C., 20% RH). These copies were then observed for generation of blank areas.

When the generation of blank areas was not more than 15 to 20%, it was considered to be a practically acceptable level.

2) Offset Temperature:

A copying test was carried out using a fixing unit Vivace 550 (remodelled) manufactured by Fuji Xerox Co., Ltd. The heat roll temperature was stepwise increased from 180° C. up to 250° C. by 5° C., and the temperature at which offset was observed visually was read. In Table 3, "no occurrence" means that offset occurrence was not observed at 250° C.

3) Temperature Causing no Scratches by Peeling claw (Non-scratch Temperature):

A copying test was carried out using a fixing unit Vivace 550 (remodelled) manufactured by Fuji Xerox Co., Ltd. at a varied heat roll temperature, and the scratches appearing on the front edge portion of a solid toner image due to the peeling claw were observed. The temperature at which the observed scratches were on a practically acceptable level was read. In Table 5, "no occurrence" means that no scratch was observed at the lowest testing temperature of 140° C.

4) Rub-off Resistance:

A test was carried out using an automatic original feed system of Vivace 550 (remodelled) manufactured by Fuji Xerox Co., Ltd. Five originals were set in the system and fed. The stains on the back side of the second to fifth originals was observed visually and graded as follows.

G0 . . . No back side stains was observed.

G1 . . . Back side stains hardly perceptible were visually observed.

G2 . . . Back side stains perceptible were visually observed.

G3 . . . Back side stains clearly noticeable were visually observed.

Grades G0 and G1 are levels acceptable for practical use.

5) Storage Stability:

The developer was allowed to stand at 50° C. and 50% RH for 17 hours and then sifted through a vibratory screen having an opening size of 63 μm for 5 minutes to examine anti-blocking properties.

G1 . . . The 63 μm screen pass ratio was 70% or more.

G2 . . . The 63 μm screen pass ratio was 40% or more and less than 70%.

G3 . . . the 63 μm screen pass ratio was less than 40%.

6) The amount of the toner transfer

The toner particles before adding a hydrophobic colloidal silica externally thereto in each Example and Comparative Example had been maintained at a condition of 40° C./50% RH for 8 hours. Then, the amount of the toner transfer per minute by a toner box of Vivace 800 (remodelled) manufactured by Fuji Xerox Co., Ltd. was measured.

The results of the evaluation of the developers obtained in Examples 6 to 10 and Comparative Examples 8 to 14 are set forth in Tables 4 and 5.

TABLE 4

| | Starting Wax | | | | | Grafting Material | | | | Modified Wax | | |
|---|---|---|---|---|---|---|---|---|---|---|---|---|
| | | | | | | | Graft | | Graft | | | |
| Example No. | Kind | Mv | Mw/Mn | Density (g/cm³) | Melt Viscosity* (cP) | Kind | Ratio (part by weight) | Kind | Ratio (part by weight) | Penetration (dmm) | Melt Viscosity* (cP) | Hexane Extraction (%) |
| Example 6 | polyethylene | 1130 | 1.30 | 0.96 | 12.0 | styrene | 25 | — | — | ≦1 | 28.5 | 62.5 |
| Example 7 | polyethylene | 1130 | 1.30 | 0.96 | 12.0 | styrene | 25 | — | — | ≦1 | 28.5 | 62.5 |
| Example 8 | polyethylene | 890 | 1.20 | 0.96 | 7.7 | styrene | 25 | — | — | ≦1 | 17.0 | 63.0 |
| Example 9 | polyethylene | 1130 | 1.30 | 0.96 | 12.0 | styrene | 12.5 | butyl methacrylate | 12.5 | ≦1 | 20.0 | 55.5 |
| Example 10 | polyethylene | 1400 | 1.12 | 0.96 | 12.0 | styrene | 25 | — | — | ≦1 | 23.7 | 61.5 |
| Comparative Example 8 | polyethylene | 900 | 2.20 | 0.95 | 10.0 | styrene | 25 | — | — | ≦1 | 22.0 | 70.0 |
| Comparative Example 9 | polyethylene | 1070 | 1.30 | 0.96 | 12.0 | styrene | 2 | — | — | ≦1 | 12.0 | 58.0 |
| Comparative Example 10 | polyethylene | 1070 | 1.37 | 0.96 | 10.0 | styrene | 25 | — | — | 1 | 22.0 | 67.0 |
| Comparative Example 11 | polyethylene | 2000 | 2.60 | 0.97 | 85.0 | — | — | — | — | — | — | 45.0 |
| Comparative Example 12 | polyethylene | 1070 | 1.30 | 0.96 | 12.0 | styrene | 12.5 | dibutyl fumarate | 54 | 2 | 130 | 65.0 |
| Comparative Example 13 | polypropylene | 3000 | 2.80 | 0.89 | 70.0 | styrene | 25 | — | — | 1 | 250 | 75.0 |
| Comparative Example 14 | polyethylene | 1070 | 1.37 | 0.96 | 10.0 | styrene | 12.5 | dibutyl fumarate | 12.5 | 1 | 16.0 | 71.5 |

Note:
*Measured at 160° C.

TABLE 5

| | Generation of Blank Areas | | Offset | Non-scratch | | | Toner |
|---|---|---|---|---|---|---|---|
| Example No. | 30° C., 90% RH (%) | 10° C., 20% RH (%) | Temperature (°C.) | Temperature (°C.) | Rub-off Resistance | Storage Stability | Transfer (g/min) |
| Example 6 | 14 | 16 | no occurrence | no occurrence | G0 | G1 | 2.3 |
| Example 7 | 16 | 18 | no occurrence | no occurrence | G0 | G1 | 2.6 |
| Example 8 | 16 | 15 | no occurrence | no occurrence | G1 | G1 | 2.4 |
| Example 9 | 13 | 17 | no occurrence | no occurrence | G0 | G1 | 2.4 |
| Example 10 | 13 | 15 | no occurrence | no occurrence | G0 | G1 | 2.7 |
| Comparative Example 8 | 40 | 46 | 216 | 158 | G1 | G2 | 1.9 |
| Comparative Example 9 | 28 | 34 | 224 | 169 | G2 | G1 | 0.8 |
| Comparative | 39 | 52 | 239 | 139 | G2 | G2 | 0.5 |

TABLE 5-continued

| Example No. | Generation of Blank Areas 30° C., 90% RH (%) | 10° C., 20% RH (%) | Offset Temperature (°C.) | Non-scratch Temperature (°C.) | Rub-off Resistance | Storage Stability | Toner Transfer (g/min) |
|---|---|---|---|---|---|---|---|
| Example 10 | | | | | | | |
| Comparative Example 11 | 67 | 82 | 206 | 148 | G0 | G3 | 0.4 |
| Comparative Example 12 | 52 | 58 | 236 | no occurrence | G2 | G3 | 0.5 |
| Comparative Example 13 | 42 | 50 | 229 | 159 | G3 | G2 | 1.3 |
| Comparative Example 14 | 44 | 47 | 231 | 147 | G1 | G2 | 0.4 |

As mentioned above, the image formation process of the present invention comprises a transfer step of transferring a toner image formed to a transfer material using a bias roll, wherein the toner for developing electrostatic latent images for use in the image formation process essentially comprises a binder resin, a colorant and a lubricant, in which the lubricant is a polyethylene wax which is graft-modified with a styrene monomer and/or unsaturated carboxylic monomer, the lubricant having a hexane extraction of not more than 65% by weight. The image formation process of the present invention requires the consumption of less power, i.e., energy can be saved. The image formation process provides an excellent environmental safety because no ozone is generated. The process also causes no image defects or other troubles. The use of the toner of the present invention provides a good releasability at lower temperatures, satisfactory anti-offset properties, excellent powder fluidity, and undergoes no blocking phenomenon under high-temperature and high-humidity conditions. Furthermore, it provides a toner image resistant against scratches by a peeling claw of a fixing roll part and against rub-off.

While the invention has been described in detail and with reference to specific examples thereof, it will be apparent to one skilled in the art that various changes and modifications can be made therein without departing from the spirit and scope thereof.

What is claimed is:

1. A image formation process comprising the steps of forming an electrostatic latent image on an electrostatic latent image carrier, developing said electrostatic latent image with a developer to provide a toner image, transferring the toner image to a transfer material, and heat-fixing the toner image on the transfer material, wherein said developer comprises a toner for developing electrostatic latent images comprising a binder, a colorant, and 1 to 30% by weight of a lubricant which comprises a modified polyethylene wax which is obtained by homopolymerizing ethylene or copolymerizing ethylene and an α-olefin having 3 to 10 carbon atoms in the presence of a metallocene catalyst and modifying the resulting ethylene homo- or copolymer by grafting at least one grafting monomer selected from the group consisting of a styrene monomer and an unsaturated carboxylic acid monomer, and said lubricant having a hexane extraction of not more than 65% by weight, and wherein said transfer step comprises bringing a bias roll into contact with the back side of a transfer material.

2. The image formation process according to claim 1, wherein said lubricant comprises a modified polyethylene wax having a melt viscosity of 15 to 250 cP at 160° C. and a penetration of not more than 2 dmm.

3. The image formation process according to claim 2, wherein said lubricant is obtained by grafting 5 to 30 parts by weight of a styrene monomer or unsaturated carboxylic monomer onto 70 to 95 parts by weight of a polyethylene polymer having a density of not less than 0.95 g/cm$^3$, a viscosity-average molecular weight of 800 to 3,000 and a molecular weight distribution Mw (weight-average molecular weight)/Mn (number-average molecular weight) of 1.05 to 1.8.

4. The image formation process according to claim 1, wherein said transfer step comprises bringing the bias roll into contact with the back side of the transfer material at a linear pressure of 3 to 12 g/cm.

5. The image formation process according to claim 1, wherein said developer comprises a resin-coated carrier incorporated therein.

* * * * *